US006929757B2

(12) United States Patent
Ulicny et al.

(10) Patent No.: US 6,929,757 B2
(45) Date of Patent: Aug. 16, 2005

(54) OXIDATION-RESISTANT MAGNETORHEOLOGICAL FLUID

(75) Inventors: John C. Ulicny, Oxford, MI (US); Yang T. Cheng, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/647,359

(22) Filed: Aug. 25, 2003

(65) Prior Publication Data

US 2005/0045850 A1 Mar. 3, 2005

(51) Int. Cl.[7] ..... H01F 1/44
(52) U.S. Cl. ..... 252/62.62; 148/105; 148/238; 148/230
(58) Field of Search ..... 252/62.52; 148/105, 148/238, 230

(56) References Cited

U.S. PATENT DOCUMENTS

| | | | | |
|---|---|---|---|---|
| 1,838,195 A | * | 12/1931 | Sergeson | 148/230 |
| 3,764,407 A | * | 10/1973 | Hirano et al. | 148/112 |
| 3,904,448 A | * | 9/1975 | Takahashi et al. | 148/105 |
| 5,382,373 A | | 1/1995 | Carlson et al. | |
| 5,505,880 A | | 4/1996 | Kormann et al. | |
| 5,578,238 A | | 11/1996 | Weiss et al. | |
| 5,667,715 A | | 9/1997 | Foister | |
| 5,804,095 A | * | 9/1998 | Jacobs et al. | 252/62.52 |
| 5,989,447 A | | 11/1999 | Podszun et al. | |
| 6,027,664 A | * | 2/2000 | Weiss et al. | 252/62.52 |
| 6,149,832 A | | 11/2000 | Foister | |
| 6,328,819 B1 | * | 12/2001 | Lerche et al. | 148/238 |

* cited by examiner

*Primary Examiner*—C. Melissa Koslow
(74) *Attorney, Agent, or Firm*—Kathryn A. Marra

(57) ABSTRACT

A magnetorheological fluid containing magnetorheological particles which are resistant to oxidation having regions rich in diffused nitrogen located therein and a method for producing such magnetorheological fluid.

28 Claims, 5 Drawing Sheets

OXIDATION-RESISTANT MAGNETORHEOLOGICAL FLUID

TECHNICAL FIELD

The present invention relates to magnetorheological fluids. More particularly, the present invention pertains to methods for producing and treating particles used in producing magnetorheological fluids.

BACKGROUND OF THE INVENTION

Magnetorheological (MR) fluids are responsive to magnetic fields and contain a field polarizable particle component and a liquid carrier component. MR fluids are useful in a variety of mechanical applications including, but not limited to, shock absorbers, controllable suspension systems, vibration dampeners, and electronically controllable force/torque transfer devices.

The particle component of MR fluids typically includes micron-sized magnetic-responsive particles. In the presence of a magnetic field, the magnetic-responsive particles become polarized and are organized into chains or particle fibrils which increase the apparent viscosity (flow resistance) of the fluid, resulting in the development of a solid mass having a yield stress that must be exceeded to induce onset of flow of the MR fluid. The particles return to an unorganized state when the magnetic field is removed, which lowers the viscosity of the fluid.

Oxidation of ferromagnetic particles is particularly pronounced at elevated temperatures. This makes the use of MR fluids in high temperature applications such as automotive fan and transmission clutches particularly problematic.

Thus it would be desirable to provide an MR fluid containing iron particles that are resistant to oxidation. It would also be desirable to provide particles useful in MR fluids that are oxidation resistant but exhibit significant magnetization response.

SUMMARY OF THE INVENTION

The present invention is directed to a method for producing a magnetorheological fluid that includes the steps of exposing a portion of the particulate component of the MR fluid to a nitrogen-rich environment for an interval sufficient to impart a nitrogen-rich surface on the particles. The resulting particles are integrated into a suitable carrier fluid. Also disclosed is a magnetorheological fluid that includes MR particles suspended in a carrier fluid. At least a portion of the particles in the MR fluid have regions of elevated nitrogen concentrations with at least a portion of these regions positioned on the particles in a manner which retards oxidative interaction between the particulate surface and the surrounding environment.

DESCRIPTION OF THE PREFERRED EMBODIMENT

The disclosed magnetorheological fluid and method for preparing the same is predicated, at least in part, upon the discovery that particulate magnetorheological material can be treated in a manner which reduces oxidation without significantly compromising magnetic or magnetic-responsive characteristics of the particles. The present disclosure is also predicated, at least in part, upon the discovery that MR fluids containing magnetorheological particles can be enhanced or rendered more efficient by providing that at least a portion of the magnetorheological particles have a surface region which exhibits elevated levels of nitrogen over that found in the general particle.

Figure 1:
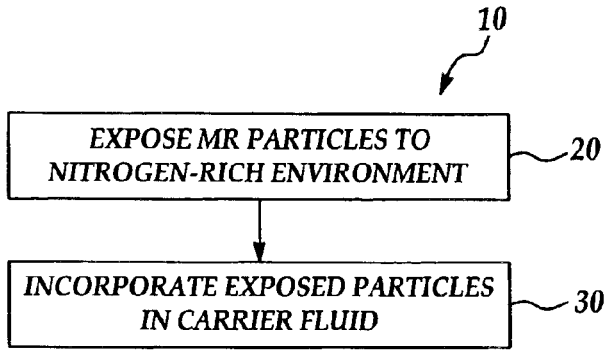
FIG. 1 is a process diagram of the method disclosed herein.

In the method as illustrated in FIG. 1 magnetorheological particles are exposed to a nitrogen-rich environment as at reference numeral 20 for an interval sufficient to impart a region of elevated nitrogen content at least proximate to the surface on the ferromagnetic particles. The ferromagnetic particles having the nitrogen-rich region are integrated into a suitable magnetorheological carrier fluid as at reference numeral 30.

As broadly construed, the magnetorheological particles or solids which can be treated in the method disclosed herein and employed in an MR fluid are those which are prone to undergoing oxidation and are composed of materials which can permit or facilitate uptake of nitrogen into the material. Suitable MR particles will exhibit at least some magnetorheological activity upon exposure to a suitable magnetic field. As used herein the term "magnetorheological activity" is defined as the ability of particles to be maintained in suspension and to align or cluster upon exposure to a magnetic field and to increase the effective viscosity or decrease the flowability of the associated magnetorheological fluid.

The particular solids suitable for use in the MR fluids as disclosed herein are magnetizable, ferromagnetic, low coercivity (i.e., little or no residual magnetism when the magnetic field is removed), finely divided particles of iron, nickel, cobalt, iron-nickel alloys, iron-cobalt alloys, iron-silicon alloys and the like. The materials may be spherical or nearly spherical in shape and have a diameter in the range of about 0.01 to about 100 microns with diameters in a range between 0.01 and 1 microns being preferred. Where the particles are employed in noncolloidal suspensions, it is preferred that the particles be at the small end of the suitable range, preferably in the range of 0.5 to 30 microns in nominal diameter or particle size, with diameters between about 1 and about 10 microns being preferred.

In the method and material as disclosed herein, the magnetorheological particles are preferably an iron powder.

The iron powder may be any form of powdered iron, particularly carbonyl iron, reduced carbonyl iron, crushed iron, milled iron, melt-sprayed iron, low carbon steel, silicon steel, potato iron, iron alloys, or mixtures of any of the previously recited materials. In the method and material disclosed herein, the preferred particle materials are carbonyl iron and reduced carbonyl iron. Suitable carbonyl iron is derived from the thermal decomposition of iron pentacarbonyl (Fe (CO) 5). Carbonyl iron materials typically contain greater than 97% iron with carbon content less than about 1%, oxygen content less than 0.5% and nitrogen content less than 1%.

Examples of other iron alloys which may be used as magnetorheological particles include iron-cobalt and iron-nickel alloys. Iron-cobalt alloys may have an iron-cobalt ratio ranging from about 30:70 to about 95:5 and preferably from about 50:50 to about 85:15, while the iron-nickel alloys have an iron-nickel ratio ranging from about 90:10 to about 99:1 and preferably from about 94:6 to 97:3. The iron alloys maintain a small amount of other elements such as vanadium, chromium, etc., in order to improve ductility and mechanical properties of the alloys. These other elements are typically present in amounts less than about 3.0 percent total by weight.

The magnetorheological particles are typically in the form of metal powders. The particle size of magnetorheological particles treated by the method and materials as disclosed herein are selected to exhibit bimodal characteristics when subjected to a magnetic field. Average particle diameter distribution size of the magnetorheological particles is generally between about 1 and about 100 microns, with ranges between about 1 and about 50 microns being preferred.

The magnetorheological particles may be present in bimodal distributions of large particles and small particles with large particles having an average particle size distribution between about 5 and about 30 microns. Small particles may have an average particle size distribution between about 1 and about 10 microns. In the bimodal distributions as disclosed herein, it is contemplated that the average particle size distribution for the large particles will typically exceed the average particle size distribution for the small particles in a given bimodal distribution. Thus, in situations where the average particle distribution size for large particles is 5 microns, for example, the average particle size distribution for small particles will be below that value. Examples of suitable magnetorheological fluids having bimodal particle distributions include those disclosed in U.S. Pat. No. 5,667,715 to Foister, the specification of which is incorporated herein.

The particles may be spherical in shape. However, it is also contemplated that magnetorheological particles may have irregular or nonspherical shapes as desired or required. Additionally, a particle distribution of nonspherical particles as disclosed herein may have some nearly spherical particles within its distribution. Where carbonyl iron powder is employed, it is contemplated that a significant portion of the particles will have a spherical or near spherical shape.

The magnetorheological particles can be integrated into a suitable carrier fluid. Suitable carrier fluids can suspend the MR particles but are essentially nonreactive. Such fluids include, but are not limited to, water, organic fluids or oil-based fluids. Examples of suitable organic and/or oil based carrier fluids include, but are not limited to, cyclo-paraffin oils, paraffin oils, natural fatty oils, mineral oils, polyphenol ethers, dibasic acid esters, neopentylpolyol esters, phosphate esters, polyesters, synthetic cyclo-paraffin oils and synthetic paraffin oils, unsaturated hydrocarbon oils, monobasic acid esters, glycol esters and ethers, silicate esters, silicone oils, silicone copolymers, synthetic hydrocarbon oils, perfluorinated polyethers and esters, halogenated hydrocarbons, and mixtures or blends thereof. Hydrocarbon oils, such as mineral oils, paraffin oils, cyclo-paraffin oils (also as napthenic oils), and synthetic hydrocarbon oils may be employed as carrier fluids. Synthetic hydrocarbon oils include those oils derived from the oligomerization of olefins such as polybutenes and oils derived from higher alpha olefins of from 8 to 20 carbon atoms by acid catalyzed dimerization, and by oligomerization using tri-aluminum alkyls as catalysts. Such poly-alpha olefin oils can be employed as preferred carrier fluids. It is also contemplated that the oil may be a suitable material such as oils derived from vegetable materials. The oil of choice may be one amenable to recycle and reprocessing as desired or required.

The carrier fluid of choice may have a viscosity between about 2 and about 1,000 centipoises at 25° C. with a viscosity between about 3 and about 200 centipoises being preferred and a viscosity between about 5 and about 100 centipoises being particularly preferred. It is contemplated that the carrier fluid portion and magnetorheological particles can be admixed to provide a composition having magnetorheological particles in an amount between about 5 and about 50 percent by volume, with amounts between 10 and 45 percent by volume being preferred, and amounts between about 20 and 45 percent by volume being particularly preferred. This corresponds to about 30 to about 90 percent by weight, with amounts between 45 and 90 percent by weight being preferred, and amounts between 65 and 90 percent by weight being particularly preferred based on the carrier fluid and particle component of the magnetorheological material having specific gravities in the range of 0.8–0.9 and 7.5–8.0, respectively.

In preparing the MR fluid according to the method disclosed herein, it is contemplated that at least a portion of the magnetorheological particles employed will have surface characteristics that prevent or minimize oxidative reaction between the particles and the surrounding environment. The magnetorheological particles exhibiting minimized oxidative interaction will be characterized by elevated nitrogen concentrations in at least at one portion of the matrix. Typically, the elevated nitrogen content is incorporated by diffusion into the particulate matrix. The diffused nitrogen material may be distributed uniformly or non-uniformly throughout the magnetorheological particle matrix. Where the nitrogen distribution is non-uniform, it is contemplated that the particles will be present with elevated nitrogen levels proximate to outer surface regions of the particles.

In the method as disclosed herein, the particles are exposed to a nitrogen-rich environment for an interval sufficient to impart a nitrogen-rich surface on the particles so exposed. As used herein, the term "nitrogen-rich environment" is taken to mean an environment in which nitrogen or a nitrogen-containing compound is present, preferably in gaseous form, in sufficient quantity or concentration to provide nitrogen for diffusion into the magnetorheological particles. The nitrogen-rich environment may be composed of nitrogen-donating materials such as nitrogen gas, ammonia, and the like. It is also contemplated that the nitrogen-rich environment may include other nonoxidative gases that do not impede the diffusion or integration of nitrogen into the magnetorheological particles. In a non-limitative example embodiment, the nitrogen-rich environment has a major portion of nitrogen and a minor portion of a gaseous material inert to interaction with the ferromagnetic particles. In another embodiment of the method as disclosed, a nitrogen-rich environment composed solely of nitrogen gas is preferred.

The magnetorheological particles are maintained in a state that permits or facilitates solubility of nitrogen in the metallic matrix of the particles for an interval sufficient to permit nitrogen uptake. In the method as disclosed herein, magnetorheological particles may be maintained at a pressure at or above standard atmospheric pressure during residence in the nitrogen-rich environment. The pressure is preferably one that will facilitate diffusion or uptake of nitrogen into the magnetorheological particles.

The magnetorheological particles are maintained at a treatment temperature, which facilitates nitrogen diffusion and/or uptake. In the process as disclosed herein, the nitrogen-rich environment is maintained at a temperature in the range of 400° C. to 500° C. at or above ambient pressure. It is to be understood that a lower processing temperature may be utilized in certain processing situations, for example when using plasma enhanced nitriding processes in a vacuum. The magnetorheological particles can be maintained in the nitrogen-rich environment for an interval sufficient to impart a nitrogen-rich diffused region in the treated ferromagnetic particles. It is contemplated that the diffused nitrogen region that results can range from several atomic layers thick to a thickness that constitutes between 5 and 25 percent of the total particulate depth. The amount of nitrogen diffusion is such that significant portions of the magnetic characteristic are maintained. Processing times can be for any interval that does not compromise the magnetic-responsive nature of the particles. As disclosed herein, the processing interval is up to 100 hours. Processing intervals between 10 and 100 hours are preferred, with processing intervals between 20 and 50 hours being most preferred.

The particulate material being treated can be maintained in the treatment environment in a manner that promotes the nitrogen diffusion process. Thus the particles may be placed in a bed of appropriate thickness to permit contact between the particles and sufficient nitrogen to facilitate nitrogen diffusion into the particulate matrix. The particles may be static or fluidized as required to permit nitrogen diffusion and/or integration.

It has been found that magnetorheological particulate materials such as carbonyl iron treated according to the method as disclosed herein exhibit elevated oxidation resistance. Without being bound to any theory, it is believed that the presence of even small percentages of integrated nitrogen can act to retard oxidative processes associated with MR fluid usage.

It has been found, quite unexpectedly, that integration of a portion of MR particles treated according to the method as disclosed herein results in an MR fluid having enhanced particulate oxidation resistance and more robust magnetic performance. The nitrogen-rich particles can constitute all or a portion of the particulate component of the MR fluid. The quantity of treated or nitrogen-rich MR particles employed will be that which maintains the magnetorheological responsiveness of the associated MR fluid within desired parameters.

The MR particles can be either monomodal or bimodal in particulate distribution. The term "bimodal" is employed to mean that the population of solid particles employed in the fluid possesses two distinct maxima in their size or diameter. The bimodal particles may be spherical or generally spherical. In bimodal compositions, it is contemplated that the particles will be in two different size populations—a small diameter size and a large diameter size. The large diameter size particle group will have a large mean diameter size with a standard deviation no greater than about two-thirds of said mean diameter size. Likewise, the smaller particle group will have a small mean diameter size with a standard deviation no greater than about two-thirds of that mean diameter value.

Preferably, the small particles are at least one micron in diameter so that they are suspended and function as magnetorheological particles. The practical upper limit on particle size is about 100 microns since particles of greater size usually are not spherical in configuration but tend to be agglomerations of other shapes. However, for the practice of the embodiments disclosed herein, the mean diameter or most common size of the large particle group preferably is 5 to 10 times the mean diameter or most common particle size in the small particle group. The weight ratio of the two groups may be within 0.1 to 0.9. The composition of the large and small particle groups may be the same or different. Carbonyl iron particles are preferred. Such materials typically have a spherical configuration and work well for both the small and large particle groups.

In MR fluids for use in high temperature applications, it is anticipated that at least a portion of particles that are more readily oxidized will be treated according to the process disclosed herein to provide nitrogen diffusion regions. In bimodal MR fluid compositions, it is contemplated that at least a portion of one particle class will be treated according to the method disclosed herein. In bimodal MR fluids, it is preferred that at least a portion of particles having small average particle distributions sizes will be treated prior to integration into the MR carrier fluid.

In an embodiment, the MR particles exposed to the nitrogen-rich environment are small ferromagnetic particles having an average particle size distribution ranging between about 1 micron and about 10 microns. It is to be understood that the method may include integrating these smaller particles with larger ferromagnetic particles prior to exposing the smaller ferromagnetic particles to the nitrogen-rich environment. In an alternate embodiment of the method, the integration of the smaller particles with the larger particles occurs after exposure to the nitrogen-rich environment. In a further embodiment, the small particles are admixed with ferromagnetic particles having an average size distribution ranging between about 5 microns and about 30 microns. In this embodiment, the admixture occurs after the small particles have been exposed to the nitrogen-rich environment. In still a further embodiment, the small particles are admixed with ferromagnetic particles having an average particle size distribution greater than about 10 microns. It is to be understood that this admixture occurs after the small particles have been exposed to the nitrogen-rich environment.

The magnetorheological fluid composition as disclosed herein will comprise magnetorheological particles of at least one average size distribution in a carrier fluid in which at least a portion of the MR particles exhibit at least one region of elevated nitrogen content. It is further contemplated that MR fluid compositions may include magnetorheological particles of at least two different size distributions. In magnetorheological fluids having multiple size distributions, it is contemplated that at least a portion of the particles of at least one size distribution will have at least one localized region of elevated nitrogen concentration. The particles having elevated nitrogen concentrations will typically be iron-containing particles with iron-containing particulate microspheres composed in whole or part of carbonyl iron being preferred. Suitable carbonyl iron includes material such as carbonyl powder having the characteristics outlined in Table 1. Examples of such material are materials commercially available from BASF under the trade designations HS and CM.

TABLE 1

Characteristics and Properties of Carbonyl Iron Materials

| Compound | BASF HS | BASF CM |
|---|---|---|
| Iron | >97.8% | >99.5% |
| Carbon | <1.0% | <0.05% |
| Oxygen | <0.5% | <0.2% |
| Nitrogen | <1.0% | <0.01% |
| Particle Size Distribution: | | |
| d10 | 1.5 micrometer | 4 micrometer |
| d50 | 2.0 micrometer | 7 micrometer |
| d90 | 3.5 micrometer | 22 micrometer |

In order to more fully understand the process of the present invention, the following illustrative examples are provided. These examples are to be considered illustrative of the present invention and in no way limit the scope or breadth of the invention herein claimed.

EXAMPLE 1

Particulate material of specific bimodal distributions of large (5–30 micron) particle size and small (1–10 micron) particle size carbonyl iron commercially available from BASF under the trade designations BASF CM and BASF HS was analyzed and prepared. The large particle size material employed was a product commercially available from BASF Corporation under the trade designation CM. The producer describes the CM material as a relatively soft spherical powder made from iron pentacarbonyl and then reduced in a nitrogen atmosphere. The manufacturer lists the mean particle diameter of the CM material as seven microns with a tap density of 3.4 g/cc.

The small particle size material employed was a product commercially available from BASF Corporation under the trade designation HS. The HS material was described by the producer as a harder and smaller material than the CM material, and is prepared by the thermal decomposition of iron pentacarbonyl without further reduction. The listed mean particle size for the HS material was 3 to 6 microns with a tap density of 3.4 g/cc. Particulate material was exposed to elevated temperature in a standard atmospheric environment. It was determined by thermogravimetric (TGA) analysis that small particle iron oxidized much more rapidly than large particle iron (BASF CM) as illustrated in FIGS. 2 and 3.

Figure 2:
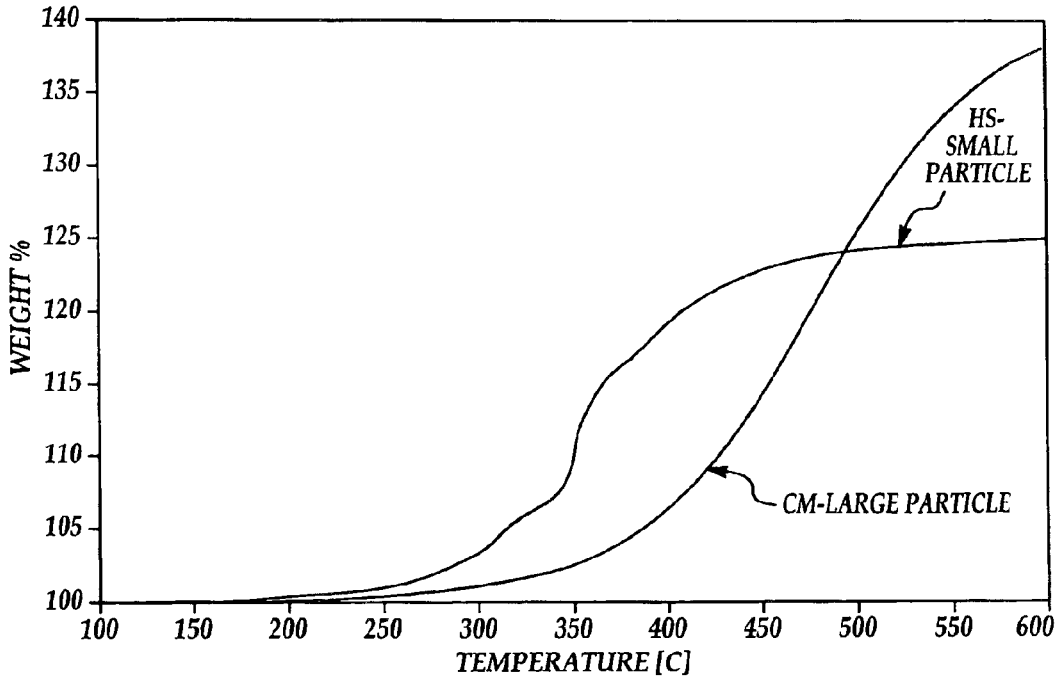
FIG. 2 is a thermogravimetric analysis of weight percent versus temperature in air for large and small particle iron powders.
Figure 3:
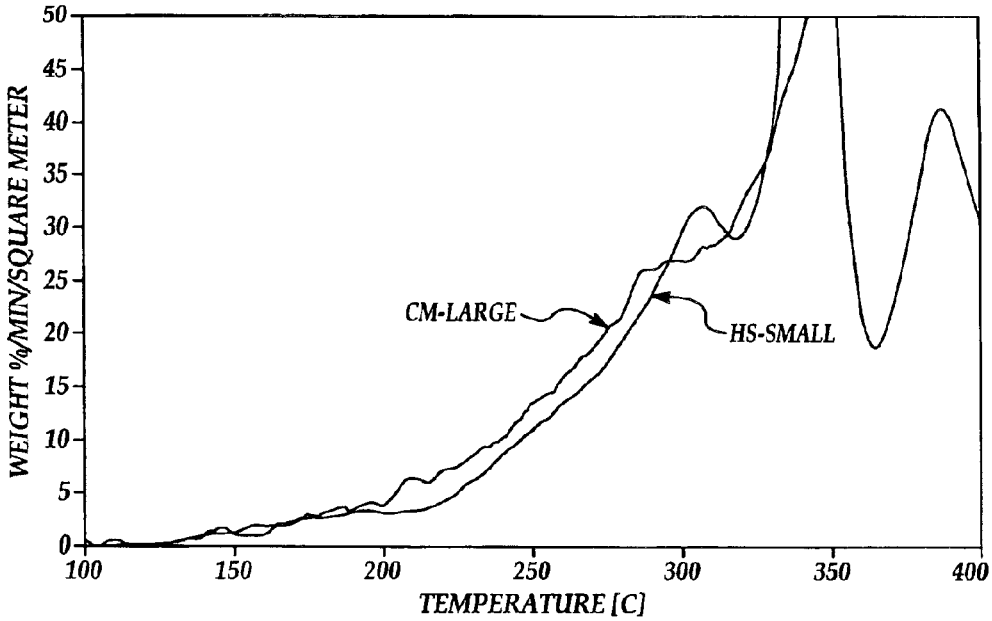
FIG. 3 is a thermogravimetric analysis of the time rate of weight gain per unit surface area versus temperature in air for large particle and small particle iron powders.
Figure 4A:
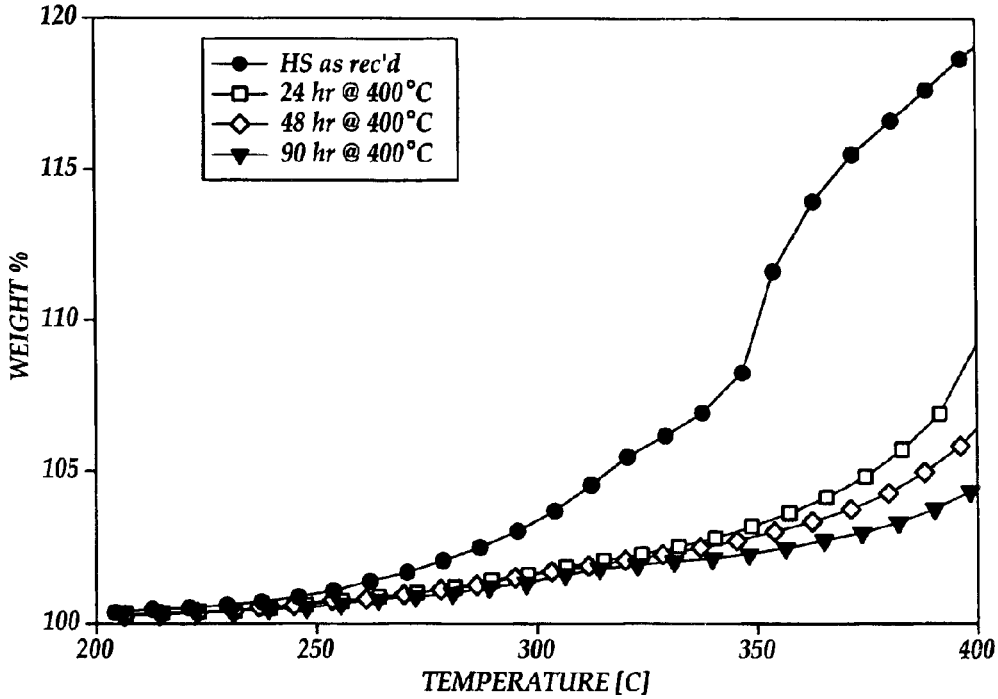
FIG. 4A is a graph of weight gain versus temperature in air for HS iron particles treated by nitriding at 400° C. for various lengths of time.
Figure 4B:
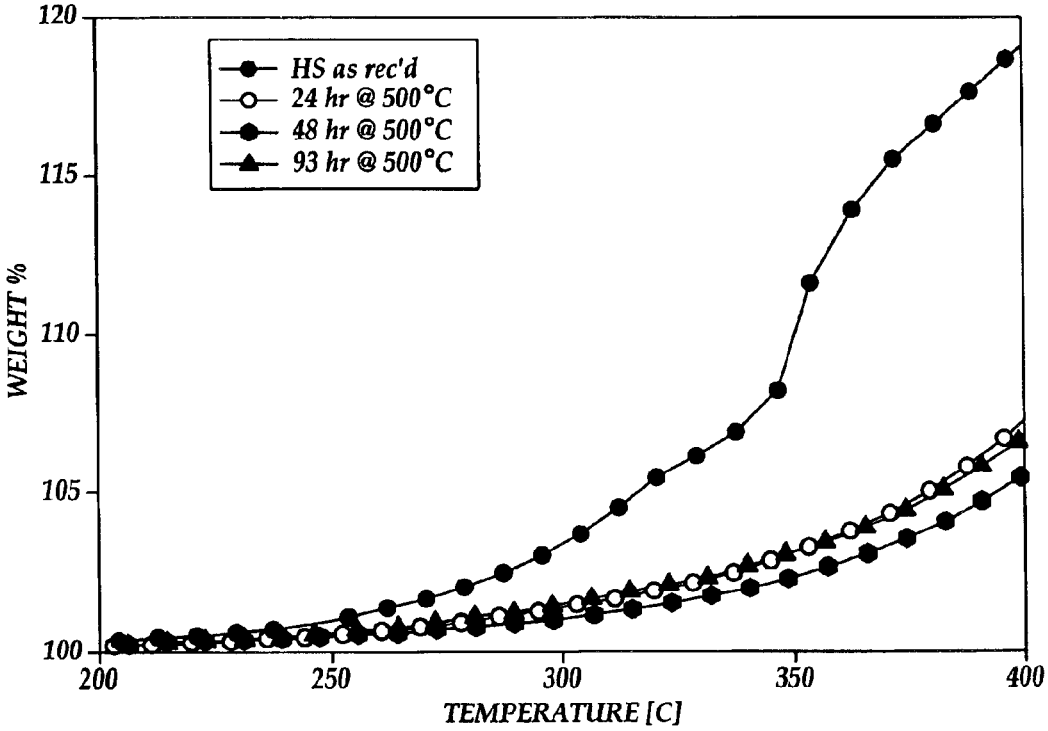
FIG. 4B is a graph of weight gain versus temperature in air for HS iron particles treated by nitriding at 500° C. for various lengths of time.
Figure 5:
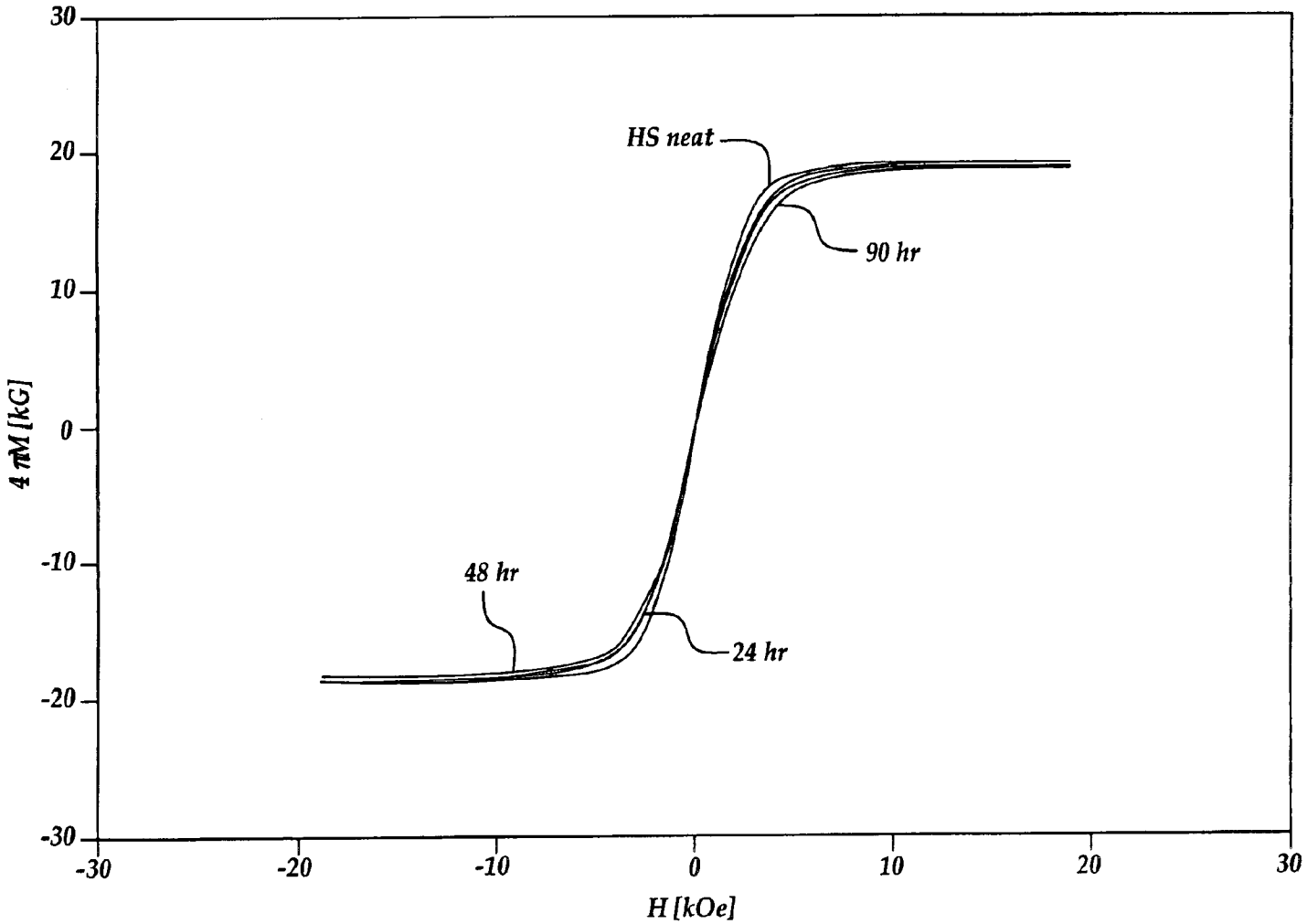
FIG. 5 is a graph of magnetization as measured by vibrating sample magnetometer (VSM) versus magnetic field strength.

It can be seen from FIGS. 2 and 3 that small particle carbonyl iron exhibited marked increases in oxidation at temperatures above 250° C., while large particle material did not exhibit oxidation increases until approximately 400° C. as seen in FIG. 4. A more detailed analysis of rate of weight gain in air per unit surface area versus temperature is depicted in FIG. 5. Both the large and small particle carbonyl materials appear to exhibit about the same weight gain per surface area below a temperature of about 300° C.

EXAMPLE 2

The various samples of small particle carbonyl iron commercially available as BASF HS were analyzed to determine weight gain due to oxidation versus temperature in air. Samples of carbonyl iron were exposed to a nitrogen rich atmosphere of 100 percent nitrogen at standard pressure for intervals of 24 hours, 48 hours, and 90 hours respectively. The various batches were processed at 400° C. or 500° C. The results are graphically illustrated in FIGS. 4A and 4B. As illustrated in FIGS. 4A and 4B, the treated materials exhibited decreased weight gain in air as compared to untreated HS carbonyl iron particles at temperatures greater than 250° C.

It can be surmised that nitriding HS iron is effective in increasing the resistance of the iron particles to oxidation as compared to untreated particles.

EXAMPLE 3

Magnetization of nitrided HS particles treated at 400° C. for intervals of 24, 48, and 90 hours were analyzed and measured with a vibrating sample magnetometer (VSM) and compared to untreated material. The results are set forth in FIG. 5. It is determined from the data summarized in FIG. 5 that no apparent change in magnetic properties of the nitrided material was evidenced for nitriding treatments up to 90 hours at 400° C.

EXAMPLE 4

Magnetorheological materials are prepared according to the disclosure found in U.S. Pat. No. 5,667,715 to Foister utilizing bimodal particle iron pentacarbonyl in which the small particle distribution is treated according to the process outlined in Example 2.

MR fluids are prepared as follows. The MR vehicle used is a suitable hydrogenated polyalphaolefin (PAO) base fluid such as SHF 21, manufactured by Mobil Chemical Company. The material is a homopolymer of hydrogenated 1-decene. It is a paraffin-type hydrocarbon and has a specific gravity of 0.82 at 15.6° C. It is a colorless, odorless liquid with a boiling range of 375° C. to 505° C. In order to suspend the small iron particles in the polyalphaolefin, a miscible polymeric gel material that includes about nine parts of a paraffinic hydrocarbon gel with the consistency of Vaseline® and one part of a suitable surfactant is thoroughly mixed with PAO base fluid. Preweighed amounts of the PAO fluid base and the polymeric gel (33% of the weight of the PAO) are mixed under high shear conditions for approximately 10 minutes. The resultant mixture is degassed and under vacuum for about 5 minutes, and then preweighed solid iron microspheres (the CM product) are added in weighed amounts to form the several MR fluid volume fraction mixtures (0.1, 0.2 . . . 0.5, 0.55). The predicted data are summarized according to the formulations in FIGS. 6 and 7. Several different fluids are formulated by adding the preweighed solid with mixing for six to eight hours, and the fluids are then again degassed before testing.

Figure 6:
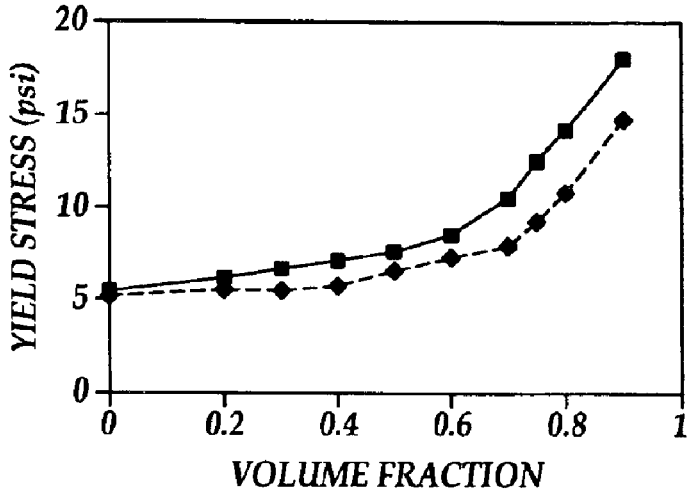
FIG. 6 is a graph of yield stress (psi) versus volume fraction of monomodal size distribution carbonyl iron particles in an MR fluid mixture under a magnetic flux density of 1 Tesla for monomodal suspensions of large (dark square) and small (dark diamond) particles.
Figure 7:
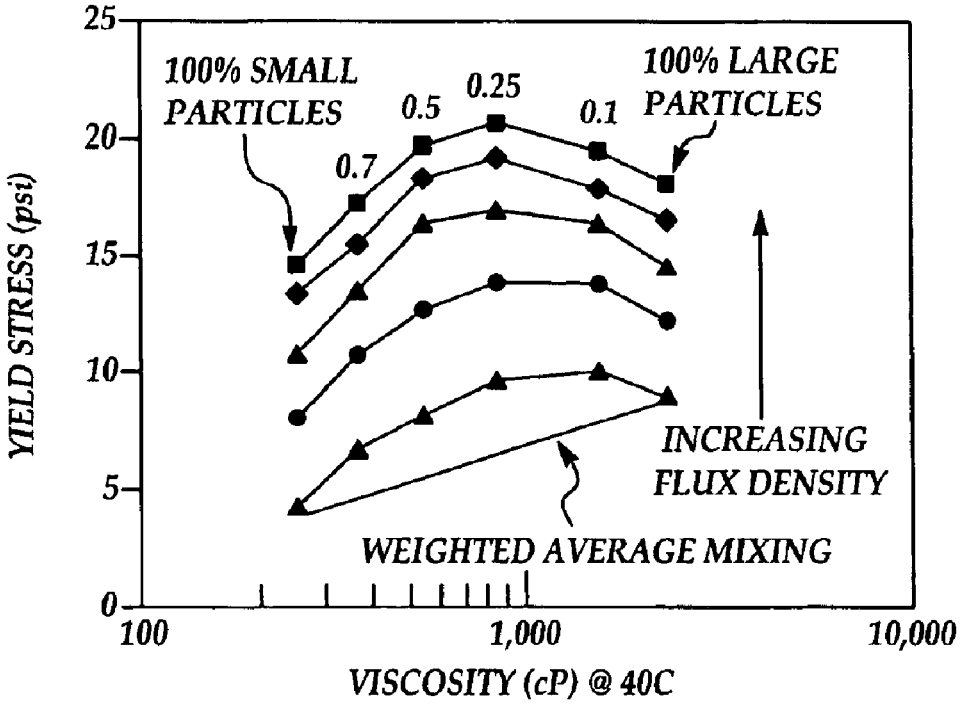
FIG. 7 is a graph of the yield stress versus viscosity at various magnetic flux densities and various ratios of large to small carbonyl iron microspheres.

The predicted effect of increasing volume fraction of the iron carbonyl microspheres on the viscosity of the PAO vehicle base MR fluids is seen in FIGS. 6 and 7. The predicted effect of volume fraction on yield stress at a magnetic field density of 1 Tesla is seen in FIG. 6.

While the invention has been described in connection with what is presently considered to be the most practical and preferred embodiment, it is to be understood that the invention is not limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as permitted under the law.

What is claimed is:

1. A method for producing a magnetorheological fluid, the method comprising the steps of:

exposing a first portion of ferromagnetic particles to a nitrogen-rich environment for an interval sufficient to impart a nitrogen-rich surface on the first portion of ferromagnetic particles;

integrating the first portion of ferromagnetic particles with a second portion of ferromagnetic particles; and integrating the first and second portions ferromagnetic particles into a magnetorheological carrier fluid.

2. The method of claim 1 wherein the ferromagnetic particles are composed of an iron material exhibiting magnetorheological characteristics.

3. The method of claim 2 wherein the ferromagnetic particles include at least one of carbonyl iron, reduced carbonyl iron, crushed iron, milled iron, melt sprayed iron, low carbon steel, silicon steel, and iron alloys.

4. The method of claim 1 wherein the nitrogen-rich environment comprises a major portion of nitrogen gas and a minor portion of a gaseous material inert to interaction with the ferromagnetic particles.

5. The method of claim 1 wherein the first portion of ferromagnetic particles has a first average size distribution and the second portion of ferromagnetic particles has a second average size distribution, wherein the average size distribution of the second portion of the ferromagnetic particles is greater than the average size distribution of the first portion of the ferromagnetic particles.

6. The method of claim 5 wherein the average size distribution of the second portion of the ferromagnetic particles is between 5 and 30 microns.

7. The method of claim 5 wherein the average size distribution of the first portion of the ferromagnetic particles is between 1 and 10 microns.

8. The method of claim 1 wherein the first portion of ferromagnetic particles includes particles having an average particle size distribution between 1 and 10 microns.

9. A method for producing a magnetorheological fluid comprising the steps of:

exposing ferromagnetic particles to a nitrogen-rich environment for en interval sufficient to impart a nitrogen-rich surface on the ferromagnetic particles; and integrating the ferromagnetic particles having a nitrogen-rich surface into a magnetorheological carrier fluid;

wherein the ferromagnetic particles exposed to the nitrogen-rich environment include particles having an average particle size distribution between 1 and 10 microns;

and wherein the ferromagnetic particles having an average particle size distribution between 1 and 10 microns are integrated with larger size ferromagnetic particles after exposure to the nitrogen-rich environment.

10. The method of claim 1 wherein the first portion of ferromagnetic particles is maintained in the nitrogen-rich environment at a temperature sufficient to initiate nitriding on the surface of the ferromagnetic particles.

11. A method for reducing oxidation of a portion of ferromagnetic particles in a magnetorheological fluid comprising the step of:

exposing a first portion at ferromagnetic particles to a nitrogen gas environment for an interval sufficient to impart a nitrogen-rich surface on the first portion of ferromagnetic particles prior to admixing the first portion of ferromagnetic particles with a second portion of ferromagnetic particles and prior to introduction of the ferromagnetic particles into the magnetorheological fluid.

12. The method of clam 11 wherein the ferromagnetic particles are composed of an iron material which when integrated with a fluid material will yield a magnetorheological fluid exhibiting at least some magnetorheological characteristics.

13. The method of claim 12 wherein the ferromagnetic particles include at least one of carbonyl iron, reduced carbonyl iron, potato iron, crushed iron, milled iron, melt-sprayed iron, and iron alloys.

14. The method of claim 11 wherein the first portion of ferromagnetic particles exposed to the nitrogen gas environment has an average particle size distribution between about 1 and 10 microns.

15. A method for reducing oxidation of ferromagnetic particles in a magnetorheological fluid comprising the step of:

exposing ferromagnetic particles to a nitrogen-rich environment for an interval sufficient to impart a nitrogen-rich surface on the ferromagnetic particles prior to introduction of the ferromagnetic particles into the magnetorheological fluid;

wherein the ferromagnetic particles exposed to the nitrogen-rich environment have an average particle size distribution between about 1 and 10 microns;

and wherein the ferromagnetic particles having an average particle size distribution in a range between 1 and 10 microns are admixed with ferromagnetic particles having and average particle size distribution in a range between about 5 and 30 microns, the admixture occurring after the ferromagnetic particles having an average particle size in a range between 1 and 10 microns have been exposed to the nitrogen-rich environment.

16. A method for reducing oxidation of ferromagnetic particles in a magnetorheological fluid comprising the step of:

exposing ferromagnetic particles to a nitrogen-rich environment for an interval sufficient to impart a nitrogen-rich surface on the ferromagnetic particles prior to introduction of the ferromagnetic particles into the magnetorheological fluid;

wherein the ferromagnetic particles exposed to the nitrogen-rich environment have an average particle size distribution between about 1 and 10 microns;

and wherein the ferromagnetic particles having an average particle size distribution between about 1 and about 10 microns are admixed with ferromagnetic particles having an average particle size distribution in a range greater than 10 microns, the admixture occurring after the ferromagnetic particles having an average particle size between about 1 and 10 microns have been exposed to the nitrogen-rich environment.

17. A method for imparting an oxidation resistant surface to a portion of magnetic metallic particles having an outwardly oriented surface and integrated into a magnetorheological fluid, the method comprising the steps of:

introducing a first portion of magnetic particles to a nitrogen gas environment;

elevating an ambient temperature of the first portion of particles and nitrogen gas environment to a temperature which facilitates uptake of nitrogen and formation of nitrogen-containing compounds proximate to the surface of the first portion of magnetic particles;

maintaining the first portion of magnetic metallic particles in the nitrogen gas environment for an interval sufficient to produce a nitrogen-rich surface coating on the first portion of the particles, admixing the first portion of particles with a second portion of magnetic particles after the first portion of magnetic particles have a nitrogen-rich surface; and integrating the first and second portions of particles into a magnetorheological fluid.

18. The method of claim 17 wherein the magnetic metallic particles include at least one of carbonyl iron, reduced carbonyl iron, crushed iron, milled iron, melt-sprayed iron, and iron alloys.

19. The method of claim 17 wherein the first portion of particles has an average size distribution in a range between 1 and 10 microns.

20. The method of claim 17 wherein the first portion of particles has an average size distribution in a range between 1 and 10 microns, and the second portion of particles has an average size distribution between 5 and 30 microns.

21. A magnetorheological fluid comprising:

first ferromagnetic particles having an average particle size in a range between 1 and 10 microns;

second ferromagnetic particles having an average particle size in a range between 5 and 30 microns; and a carrier fluid, wherein one of the first and second ferromagnetic particles have a surface characterized by nitrogen-containing compounds associated therewith.

22. The magnetorheological fluid of claim 21 wherein the first particles are composed of at least one of carbonyl iron, reduced carbonyl iron, crushed iron, potato iron, milled iron, melt-sprayed iron, and iron alloys.

23. The magnetorheological fluid of claim 21 wherein the second particles are composed of at least one of carbonyl iron, reduced carbonyl iron, crushed iron, milled iron, melt-sprayed iron, and iron alloys.

24. The magnetorheological fluid of claim 22 wherein the second particles have a surface resistant to oxidation, the surface characterized by nitrogen-containing compounds associated therewith.

25. The method as defined in claim 9 wherein the ferromagnetic particles are composed of at least one of carbonyl iron, reduced carbonyl iron, crushed iron, milled iron, melt-sprayed iron, low carbon steel, silicon steel, potato iron, iron alloys, and mixtures thereof.

26. The method as defined in claim 15 wherein the ferromagnetic particles are composed of at least one of carbonyl iron, reduced carbonyl iron, crushed iron, milled iron, melt-sprayed iron, low carbon steel, silicon steel, potato iron, iron alloys, and mixtures thereof.

27. The method as defined in claim 16 wherein the ferromagnetic particles are composed of at least one of carbonyl iron, reduced carbonyl iron, crushed iron, milled iron, melt-sprayed iron, low carbon steel, silicon steel, potato iron, iron alloys, and mixtures thereof.

28. A method for producing a magnetorheological fluid, the method comprising the steps of:

exposing ferromagnetic particles to a nitrogen gas environment for an interval sufficient to impart a nitrogen-rich surface on the ferromagnetic particles, the ferromagnetic particles composed of a first portion of ferromagnetic particles having a first average size distribution and a second portion of ferromagnetic particles having a second average size distribution, wherein the average size distribution of the first portion of the ferromagnetic particles is greater than the average size distribution of the second portion of the ferromagnetic particles, wherein the second portion of the ferromagnetic particles is exposed to the nitrogen gas environment for an interval sufficient to impart a nitrogen-rich surface on the second portion of the ferromagnetic particles;

integrating the ferromagnetic particles having a nitrogen-rich surface into a magnetorheological carrier fluid; and integrating the first portion of the ferromagnetic particles with the second portion of the ferromagnetic particles after exposure to the nitrogen gas environment and prior to the integration into the magnetorheological carrier fluid.

* * * * *